United States Patent [19]

Cargile, Jr.

[11] Patent Number: 4,706,879

[45] Date of Patent: Nov. 17, 1987

[54] FOLDING CARTON WITH IMPROVED THREAD AND PUNCH LOCK

[75] Inventor: John W. Cargile, Jr., Decatur, Ga.

[73] Assignee: Kliklok Corporation, Decatur, Ga.

[21] Appl. No.: 936,495

[22] Filed: Dec. 1, 1986

Related U.S. Application Data

[63] Continuation of Ser. No. 824,064, Jan. 30, 1986, abandoned.

[51] Int. Cl.[4] ..... B65D 5/26

[52] U.S. Cl. ..... 229/194; 229/155

[58] Field of Search ..... 229/35, 36, 48 R, 155, 229/193, 194, 156–158

[56] References Cited

U.S. PATENT DOCUMENTS

| | | | |
|---|---|---|---|
| 379,891 | 3/1889 | Harley | 229/35 |
| 1,090,457 | 3/1914 | Davidson et al. | 229/36 |
| 1,335,701 | 3/1920 | Rainsburg | 229/35 |
| 2,133,736 | 10/1938 | Balin | 229/36 |
| 2,303,796 | 12/1942 | Rueckert | 229/36 |
| 2,492,454 | 12/1949 | Anderson, Jr. | 229/36 |
| 2,660,363 | 11/1953 | Trickett, Jr. et al. | 229/35 |
| 2,895,663 | 7/1959 | Paige | 229/35 |
| 3,081,017 | 3/1963 | Gerbino | 229/155 |
| 3,261,535 | 7/1966 | Krause | 229/35 |
| 3,380,645 | 4/1968 | Pierce, Jr. | 229/35 |
| 3,456,420 | 7/1969 | Ganz | 229/40 |
| 3,955,748 | 5/1976 | Calvert | 229/40 |

FOREIGN PATENT DOCUMENTS

| | | | |
|---|---|---|---|
| 2555932 | 6/1977 | Fed. Rep. of Germany | 229/35 |
| 1355643 | 2/1964 | France | 229/36 |
| 323799 | 8/1957 | Switzerland | 229/35 |
| 11611 | of 1905 | United Kingdom | 229/35 |

*Primary Examiner*—Stephen Marcus
*Assistant Examiner*—Gary E. Elkins
*Attorney, Agent, or Firm*—King & Schickli

[57] ABSTRACT

A folding container such as a tray, carton or the like constructed of paperboard includes an interior end panel articulated to a bottom wall panel and including a relief slit to ensure full engagement of a thread and punch lock on first and second end panels articulated to opposite sidewall panels. The first locking end panel includes a locking assembly comprising a tongue and cooperating locking tab. The second locking end panel includes a receipt aperture for the lock assembly. When locked in overlapping relation, the tongue and tab are respectively threaded and snapped into the receipt aperture to provide secure engagement. The relief slit is substantially U-shaped with the open end of the U directed toward the lock assembly receipt aperture when the end panels are in overlapping relation. The relief slit extends substantially around the tab engaging edge of the lock assembly receipt aperture so as to provide sufficient relief for the full and complete engagement of the locking tab.

12 Claims, 12 Drawing Figures

FOLDING CARTON WITH IMPROVED THREAD AND PUNCH LOCK

This is a continuation of application Ser. No. 824,064 filed Jan. 30, 1986 now abandoned.

TECHNICAL FIELD

The present invention relates generally to the packaging field and, more particularly, to a folding container, tray or carton having a thread and punch lock on an end panel locking structure that insures full and reliable locking engagement during each carton erecting cycle.

BACKGROUND OF THE INVENTION

Cartons, trays and other folding containers having end panel locking structures are known in the art. Particularly, the end walls of the carton are formed by overlapping end wall panels articulated to the side and bottom walls of the carton body and locked together with tongues, tabs and slits or the like. Boxes and cartons of this type are used to package a wide range of goods from, for example, cookies to automobile parts.

U.S. Pat. No. 1,425,256 to Hickman et al discloses a berry container having an end panel locking structure. Overlapping end panels articulated to the carton sidewalls include a cooperating tab and slit structure providing locking action. A third, solid interior end panel articulated to the bottom wall provides increased strength to the carton.

While the Hickman concept provides a strong and secure carton, it is not without its disadvantages. The Hickman carton is not designed for erection on the high speed carton forming and erecting machinery required to be economically competitive in the marketplace of today. Specifically, the solid interior end panel can sometimes provide a hinderance to secure engagement of the end lock. It has been found that the solid interior end panel resists proper overtravel of the locking tab as it is punched into position by the punch-in finger of the erecting machinery. Without complete engagement of the locking tab in the cooperating slit being assured, consistent carton erection cannot be obtained.

U.S. Pat. No. 3,206,098 to Stenger et al provides a portion of the locking structure of the overlapping end panels extending above the upper limit of the solid interior end panel. This structure allows some relief and flexibility to aid in lock engagement.

The Stenger carton, however, suffers from several disadvantages. The lock structure is complicated and often interferes with product loading and/or smooth operation of the hinged carton top. The upper edge portion of the lock presents a jagged edge that can hang on the product as it is being inserted, or catch the lower edge of the charlotte flaps on the top as the carton is being closed. Further, since the interior end panel does not extend along the entire depth, it does not provide the desired degree of isolation of the carton contents from outside elements as, for example, when packaging semi-exposed food products, such as butter patties.

A need is, therefore, identified for a carton with an improved thread and punch lock on the overlapping end panels.

SUMMARY OF THE INVENTION

Accordingly, it is a primary object of the present invention to provide a folding container, tray or carton having an improved locking structure overcoming the above-described limitations and disadvantages of the prior art.

Another object of the present invention is to provide a carton with a locking structure of added strength and reliability that also assures isolation of the carton contents from outside elements.

Still another object of the present invention is to provide a carton with a locking structure that substantially eliminates interference with product loading and top closure.

A further object of the present invention is to provide a carton with an end panel locking structure that is easier to erect and that ensures full engagement of the lock during each carton erecting cycle.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects and in accordance with the purposes of the present invention as described herein, an improved container, tray or carton formed from a single sheet of foldable material is provided. The carton includes a bottom wall panel and a pair of oppositely disposed sidewall panels articulated to the bottom wall panel. First and second locking end panels articulated to the sidewall panels are adapted to overlap each other and overlie an interior end panel when locked. The interior end panel articulated to the bottom wall panel provides additional strength to the container. The interior end panel further isolates the container interior and contents from outside elements all along the lock. Advantageously, relief means in the form of a slit in the interior end panel allows full engagement of the locking means of the first and second locking end panels during carton erection, as will be more fully explained below.

Preferably, the first locking end panel includes a locking assembly. The locking assembly includes a tongue and cooperating locking tab longitudinally aligned along the end panel. The second locking end panel includes a lock assembly receipt aperture. When the tongue and tab are inserted and punched into the receipt aperture of the second locking end panel, secure locking action is provided through desirable four-point engagement.

Preferably, the relief slit along the interior end panel is substantially U-shaped and in alignment with the locking tab. The open end of the U is directed toward the lock assembly receipt aperture when the end panels are in overlapping or erected position. In this position, the slit extends along the interior end panel adjacent the edge of the receipt aperture. Thus, the interior end panel provides the desired relief as the mechanical punch-in finger secures the lock structure, and at the same time provides the desired protection of the carton contents from outside elements along the entire lock.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of this specification, illustrates several aspects of the present invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
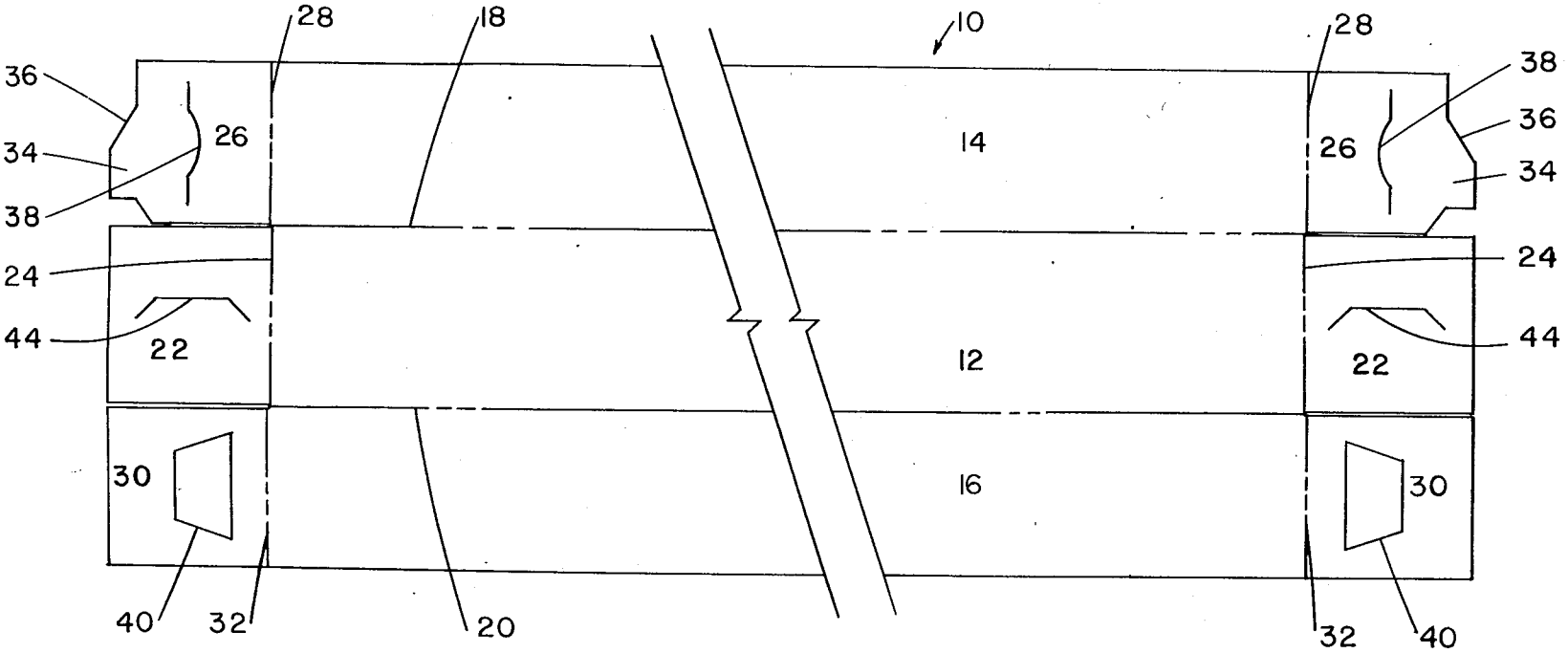
FIG. 1 is a top plan view of a paperboard blank for folding into a tray including a thread and punch lock of the present invention.

Reference is now made to FIG. 1 showing a tray blank 10 including the end panel thread and punch lock constructed in accordance with the principles of the present invention. The blank 10 is preferably formed from a single sheet of coated paperboard. The blank 10 has a generally elongated, rectangular shape and is formed having a bottom panel 12, a pair of side panels 14, 16 articulated to opposite sides of the bottom panel 12 at side panel fold lines 18, 20 respectively. An interior end panel 22 is articulated to each end of the bottom wall panel 12 along an end panel fold line 24. A first locking end panel 26 is articulated to each end of the side panel 14 along fold line 28 while a second locking end panel 30 is articulated to each end of the sidewall panel 16 along the fold line 32. The blank 10 is erected into a tray by folding the side panels 14, 16 and end panels 22, 26 and 30 in overlapping relation as shown in the drawing figures and described in detail below.

The first locking end panels 26 each include a lock assembly comprising a tongue 34 along the outer edge 36 and a cooperating locking tab 38 longitudinally spaced from the tongue along a mid-portion of the panel. The tongue 34 and cooperating locking tab 38 of the first locking end panel 36 are received in an aperture 40 in the second locking end panel 30 to securely lock the end panels of the tray or carton in the erected position. With both the tongue 34 and cooperating locking tab 38 received in the aperture 40, secure engagement is provided at at least four points 42 (note FIG. 5).

The interior end panels 22 each include a relief slit 44 of substantially U-shape and substantially in alignment with the locking tab 38. When folded into proper overlapping relation during tray or carton erection, the open end of the substantially U-shaped relief slit 44 is also directed toward and substantially surrounds one side of the receipt aperture 40 in the second locking end panel 30 (note FIG. 3). In fact, the relief slit 44 is spaced from, but adjacent one edge 46 of the receipt aperture 40. Thus, it should be appreciated that the interior end panel 22 with relief slit 44 provides firm backup to the edge 46 of the lock assembly receipt aperture 40, but at the same time allows inward travel of a punch-in finger (see FIG. 5A). This action allows reliable, full engagement of the locking tab 38 with the aperture edge 46. Further, the interior panel 22 provides additional strength to the carton and support to the locking panels 26, 30. Since there is no opening in the panel 22 but only a slit 44, the desirable isolation of the interior of the erected tray or carton is obtained.

Figure 3:
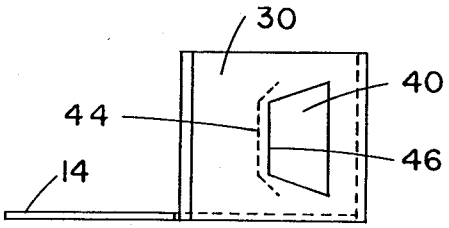
FIGS. 2–5 and related figures are end elevational, cross section and top views showing the step-by-step erection of a tray including a thread and punch lock and end panel with relief means constructed in accordance with the teachings of the present invention.
Figure 3A:
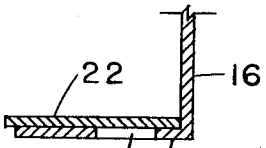
Figure 3B:
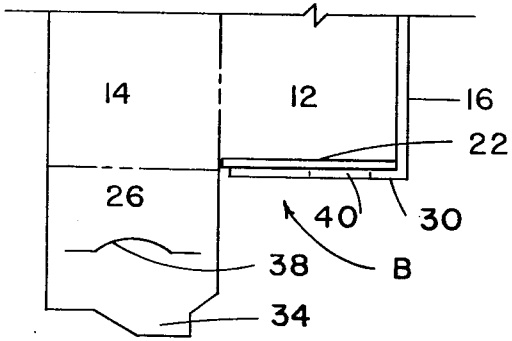
Figure 2:
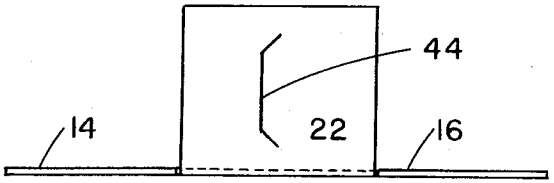
Figure 2B:
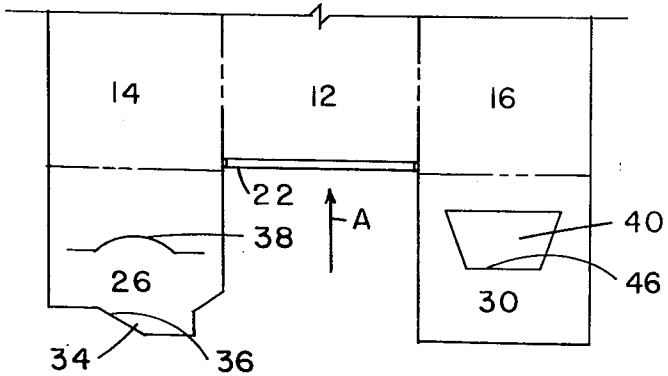

As shown in FIGS. 2 and 2B, the initial erecting and thread and punch lock engaging step comprises the upward folding (note action arrow A) of the interior end panel 22 along the fold line 24. Next, the sidewall panel 16 is upwardly folded about the fold line 20 and the second locking end panel 30 is folded inwardly, as shown in FIGS. 3, 3A and 3B (see action arrow B).

Figure 4:
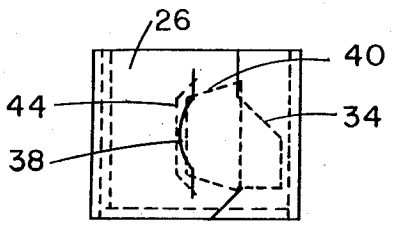
Figure 4A:
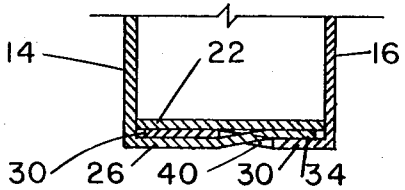
Figure 4B:
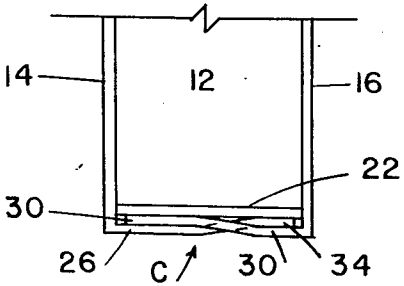

The opposite sidewall panel 14 is now folded upwardly along the fold line 18 to a position parallel to the now folded sidewall panel 16. The first locking end panel 26 is then folded inwardly (note action arrow C and FIGS. 4, 4A and 4B) to overlie the second locking end panel 30. The tongue 34 is inserted or threaded through the lock receipt aperture 40 (note FIG. 4B).

Figure 5:
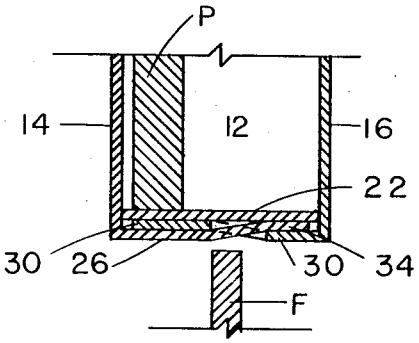
Figure 5A:
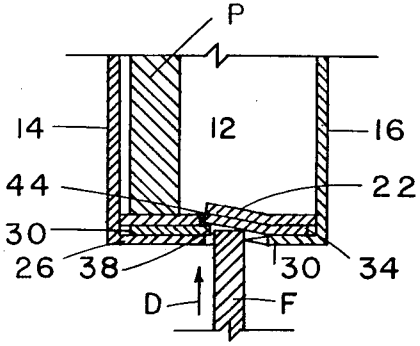
Figure 6:
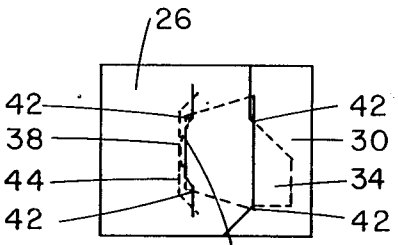
FIG. 6 is an end elevational view of the tray with the lock fully engaged.

The final lock securing step is shown in FIGS. 5, 5A and 6. The backup piece P of the automated high speed erecting machinery is inserted into the carton to engage one side of the interior end panel 22. The tab punch-in finger F is then moved in the direction of action arrow D to engage the locking tab 38 and snap the tab 38 past the edge 46 of the aperture 40. This locking action fully and completely provides the overlapping end panels 26, 30 with secure engagement at the four points 42 (see FIG. 6). Advantageously, the relief slit 44 in the interior end panel 22 allows the proper inward movement to the paperboard to assure full engagement of the locking tab 38.

In summary, numerous benefits have been described which result from employing the concepts of the present invention. In particular, the full depth interior end panel 22 provides added strength to the carton and assures isolation of the carton contents from outside elements all along the lock. Additionally, the relief slit 44 in the end panel 22 simplifies the carton or tray erection process, and assures full and reliable engagement of the thread and punch lock during each carton erecting cycle.

The foregoing description of the preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

I claim:

1. A folding end lock carton including a bottom wall panel and a pair of oppositely disposed side wall panels articulated to said bottom wal panel, comprising:

an interior end panel articulate to said bottom wall panel for providing additional strength to said carton and further isolating the carton interior along the lock from outside elements;

first and second locking end panels including locking means, and first and second locking end panels being articulated to said side wall panels and overlapping each other end overlying said interior end panel when locked; and relief means formed on said interior end panel to insure full engagement of said locking means of said overlying first and second locking end panels, said relief means being separate from said locking means so that no portion of said locking means extends through said relief means into said carton interior when in the locked position.

2. The folding end lock carton set forth in claim 1, wherein said locking means includes a tongue and cooperating locking tab.

3. The folding end lock carton set forth in claim 2, wherein said locking means includes a receipt aperture on said second locking end panel providing edge-to-edge four point engagement with said tongue and cooperating locking tab.

4. The folding end lock carton set forth in claim 3, wherein said relief means is a slit in said interior end panel substantially in alignment with said tab and a corresponding edge of said aperture.

5. The folding end lock carton set forth in claim 4, wherein said slit is substantially U-shaped.

6. A folding end lock carton including a bottom wall panel and a pair of oppositely disposed side wall panels articulated to said bottom wall panel, comprising:

an interior end panel articulated to said bottom wall panel for providing additional strength to said carton and further isolating the carton interior along the lock from outside elements;

a first locking end panel connected to one of said side wall panels, said first locking end panel including a lock assembly having a tongue and cooperating locking tab;

a second locking end panel connected to the other of said side wall panels, said second locking end panel including a lock assembly receipt aperture for retaining said lock assembly in a locked position when said first and second locking end panels are in an overlapping relation overlying said interior end panel; and relief means formed on said interior end panel to insure full engagement of said overlying lock assembly and lock assembly receipt aperture, said relief means being separate from said locking means so that no portion of said locking means extends through said relief means into said carton interior when in the locked position.

7. The folding end lock carton set forth in claim 6, wherein said relief means is a slit in said interior end panel substantially in alignment with said tab and corresponding edge of said aperture.

8. The folding end lock carton set forth in claim 7, wherein said slit is substantially U-shaped.

9. The folding end lock carton set forth in claim 8, wherein said U-shaped slit is directed with an open end toward said lock assembly receipt aperture.

10. The folding end lock carton set forth in claim 7, wherein said slit when locked extends along said interior end panel adjacent a tab engaging edge of said lock assembly receipt aperture.

11. A thread and punch lock for a container, comprising:

an interior panel providing additional strength to the carton and isolating the carton interior along the lock from outside elements;

first and second locking panels including locking means, said first and second panels overlapping each other and overlying the interior panel when locked; and relief means formed on the interior panel to insure full engagement of said lock means of said overlying first and second locking panels during locking, said relief means being separate from said locking means so that no portion of said locking means engages said relief means and extends into said carton interior when in the locked position.

12. The thread and punch lock of claim 11 wherein said locking means of said first panel includes a tongue and cooperating locking tab, said second panel includes an aperture for receipt of said tongue and tab and said relief means includes a slit substantially in alignment with said tab and a corresponding edge of said aperture.

* * * * *